US012486666B2

(12) United States Patent
Bodwell et al.

(10) Patent No.: US 12,486,666 B2
(45) Date of Patent: Dec. 2, 2025

(54) PANELIZED SYSTEM AND METHOD OF ASSEMBLING A BUILDING USING A PANELIZED SYSTEM

(71) Applicant: Verco Decking, Inc., Phoenix, AZ (US)

(72) Inventors: Patrick Allen Bodwell, Auburn, CA (US); Scott A. Russell, Norfolk, NE (US); Bruce F. Brothersen, Brigham City, UT (US); Russell J. Balvin, Norfolk, NE (US)

(73) Assignee: VERCO DECKING, INC., Phoenix, AZ (US)

( * ) Notice: Subject to any disclaimer, the term of this patent is extended or adjusted under 35 U.S.C. 154(b) by 626 days.

(21) Appl. No.: 17/732,627

(22) Filed: Apr. 29, 2022

(65) Prior Publication Data

US 2022/0349180 A1 Nov. 3, 2022

Related U.S. Application Data

(60) Provisional application No. 63/182,406, filed on Apr. 30, 2021.

(51) Int. Cl.

| | |
|---|---|
| ***E04C 3/04*** | (2006.01) |
| ***E04B 5/10*** | (2006.01) |
| ***E04C 3/02*** | (2006.01) |

(52) U.S. Cl.

CPC ..... *E04C 3/04* (2013.01); *E04B 5/10* (2013.01); *E04C 2003/026* (2013.01); *E04C 2003/0404* (2013.01); *E04C 2003/0408* (2013.01); *E04C 2003/0417* (2013.01); *E04C 2003/0434* (2013.01); *E04C 2003/046* (2013.01)

(58) Field of Classification Search

CPC ..... E04B 5/10; E04C 3/04; E04C 2003/026; E04C 2003/0404; E04C 2003/0408; E04C 2003/0417; E04C 2003/0434; E04C 2003/046

See application file for complete search history.

(56) References Cited

U.S. PATENT DOCUMENTS 3,208,725 A * 9/1965 Fleming ..... E04G 17/18 248/354.3
4,102,096 A * 7/1978 Cody ..... E04B 1/24 52/646
4,619,090 A * 10/1986 McManus ..... E04C 3/02 52/378

(Continued)

*Primary Examiner* — Jessie T Fonseca
(74) *Attorney, Agent, or Firm* — Moore & Van Allen PLLC; Jeffrey R. Gray

(57) ABSTRACT

A panelized system for structural decking systems. The panelized system has a plurality of joists operatively coupled together through one or more decking panels. In order to aid in resisting rollover (e.g., the joists rotating with respect to the decking panels and/or support members during installation) bracing members may be utilized. A bracing member may be operatively coupled to a joist (e.g., a lower chord of a joist, web, upper chord, or the like) and to the decking panel (e.g., location on the decking between two joists, such as the mid-point of decking between two joists, or the like). In this way, the joists may be supported directly to the decking instead of having to run cross-bracing (e.g., x-shaped, or the like) between each of the joists. Once the panelized system is assembled on the ground, the panelized system may be lifted into place and assembled to a building.

20 Claims, 11 Drawing Sheets

(56) References Cited

U.S. PATENT DOCUMENTS

| | | | | |
|---|---|---|---|---|
| 5,085,398 | A * | 2/1992 | Holcomb | E04G 17/18 249/211 |
| 5,271,596 | A * | 12/1993 | Holcomb | E04G 11/42 249/211 |
| 5,937,608 | A * | 8/1999 | Kucirka | E04G 23/0218 52/693 |
| 6,212,830 | B1 * | 4/2001 | MacKarvich | E04G 23/0218 248/354.3 |
| 6,230,448 | B1 * | 5/2001 | Oliver | E04G 23/0218 248/200.1 |
| 6,334,279 | B1 * | 1/2002 | Oliver | E04G 23/0218 248/354.3 |
| 8,844,209 | B1 * | 9/2014 | Oliver | E04B 1/34347 52/157 |
| 9,206,580 | B2 * | 12/2015 | Oliver | E02D 27/01 |
| 10,774,495 | B2 * | 9/2020 | Oliver | E02D 27/48 |
| 2008/0000177 | A1 * | 1/2008 | Siu | E04C 5/065 52/319 |
| 2010/0192507 | A1 * | 8/2010 | Studebaker | F16B 25/103 52/704 |
| 2019/0169866 | A1 * | 6/2019 | Benton | E04C 3/08 |

* cited by examiner

PANELIZED SYSTEM AND METHOD OF ASSEMBLING A BUILDING USING A PANELIZED SYSTEM

CROSS REFERENCE AND PRIORITY CLAIM UNDER 35 U.S.C. § 119

This application claims priority to U.S. Provisional Application No. 63/182,406 entitled "Panelized System and Method of Assembling a Building Using a Panelized System" filed on Apr. 30, 2021, which is assigned to the assignee hereof and the entirety of which is incorporated by reference herein.

FIELD

This application relates generally to the field of structural decking systems, and more particularly to panelized decking systems for structural roof and/or floor decking systems.

BACKGROUND

Structural wall, roof, or floor panels are used in commercial or industrial construction (and in some cases residential construction), for example, in commercial buildings, industrial buildings, institutional buildings, or the like. Structural panels may be typically manufactured from steel sheets, which may or may not be coiled. In order to increase the structural strength and the stiffness of the individual steel sheets, structural decking panels with longitudinal flutes are formed from the steel sheets via roll forming, break forming, bending, stamping, or other like processes. The structural panels are secured to each other in order to form a structural panel system when installed (e.g., wall system, roof system, floor system, or combination thereof). The structural panels are also connected to the other load bearing structural support members of a building, such as joists, which in turn are secured to horizonal support members (e.g., girders, or the like) through the use of joist seats on the joists and/or vertical support members (e.g., vertical columns) through the horizonal support members.

BRIEF SUMMARY

Structural decking panels (otherwise described as "structural panels," "decking panels," "decking," or "panels") utilized within a structural decking system of a building typically include longitudinal flutes (e.g., upper flange, lower flange, and webs that form a single flute as discussed in further detail later) that extend longitudinally along the length of the panel in order to provide structural strength to the panels, and thus, to the structural decking system and to the building. The structural decking panels typically comprise two edges and two ends. The edges of structural decking panels extend parallel with the longitudinal flutes, while the ends of the structural decking panels extend perpendicular (or transverse) to the longitudinal flutes. As such, one edge of the structural decking panels may be described as a "first edge" (or a "top edge" or "left edge") while the second edge of the structural decking panels may be described as a "second edge" (or a "bottom edge" or "right edge"). The ends of the structural decking panels may be described as a "first end" (or a "top end" or "left end") and a "second end" (or a "bottom end" or "right end"). As part of assembling a panel, roof, or floor, the structural decking is operatively coupled together (e.g., through sidelaps at the edges, or the like) and to a plurality of joists, which are operatively coupled to support members to form structural decking systems. In some embodiments portions of the structural decking systems, called panelized systems (e.g., joists, joist seats, bracing, structural decking panels, or the like) may be assembled to form a portion of the roof or floor before being lifted (e.g., hoisted by a crane, forklift, or the like) into place and attached to girders. These structures formed by panelized systems, or otherwise installed directly on the structures, often have concrete poured on them to form a floor or roof and must resist wind, earthquake (in some locations), or other types of loading during and after installation.

Embodiments of the present invention relate to a panelized system for structural decking systems. The panelized system typically comprises a plurality of joists operatively coupled together through one or more decking panels. In order to aid in resisting rollover (e.g., the joists rotating with respect to the decking panels and/or support members of the building during installation) or to resist wind uplift forces during or after installation, bracing members may be utilized. In the present invention, a bracing member may be operatively coupled to a joist (e.g., a lower chord of a joist, web, upper chord, or the like) on one end and directly to the decking panel (e.g., between two joists, such as the midpoint of decking between two joists, or the like) on the other end. In this way, the joists may be supported directly to the decking instead of having to install cross-bracing (e.g., x-shaped, or the like) and/or horizontal bracing (e.g., bracing directly between bottom chords, bracing directly between upper chords, and/or bracing directly between webs) between each of the joists, as will be discussed in further detail herein. Once the panelized system is assembled on the ground, the panelized system may be lifted into place in the structure and operatively coupled to one or more support members (e.g., beams, joist girders, or the like) of a structure using a connector (e.g., fasteners, welds, or the like).

One embodiment of the invention is a system for a structure. The system comprises a plurality of joists, one or more decking panels operatively coupled to the plurality of joists, and one or more brace members. Each of the one or more brace members have a first end and a second end. The first end is operatively coupled to a joist of the plurality of joists and the second end is operatively coupled to a panel of the one or more the decking panels between two adjacent joists.

In further accord with embodiments of the disclosure, the plurality of joists, the one or more decking panels, and the one or more brace members are pre-formed into a panelized system. The panelized system is lifted for operative coupling to one or more support members of the structure.

In other embodiments, the plurality of joists lack cross-bracing and horizontal bracing between adjacent joists of the plurality of joists.

In still other embodiments, the first end of the one or more brace members is operatively coupled to a lower chord of the joist.

In yet other embodiments, the second end of the one or more brace members is operatively coupled to the panel at a bottom flange, a top flange, or a web of the panel.

In other embodiments, the second end of the one or more brace members is operatively coupled at a mid-point of the panel between the two adjacent joists of the plurality of joists.

In further accord with embodiments of the disclosure, the one or more brace members comprise a L-shaped portion formed from a first leg and a second leg.

In other embodiments, the one or more brace members comprise a first brace connection member adjacent a first end of the one or more brace members.

In still other embodiments, the first brace connection member comprises a flange extending from the first end of the one or more brace members.

In yet other embodiments, the system further comprises a brace connector extending through the first brace connection member and a chord cavity formed between a first lower chord angle and a second lower chord angle.

In other embodiments, the system further comprises a joist connection member operatively coupled to a joist of the plurality of joists. The first end of a brace member is operatively coupled to the joist connection member.

In further accord with embodiments of the disclosure, the joist connection member is a bracket, clip, or angle.

In other embodiments, the one or more brace members comprise a second brace connection member adjacent a second end of the one or more brace members.

In still other embodiments, the second brace connection member comprises a flange extending from the second end of the one or more brace members.

In yet other embodiments, the system further comprises a brace connector operatively coupling the second brace connection member to the one or more decking panels.

In other embodiments, the system further comprises a panel connection member operatively coupled to a portion of a decking panel of the one or more decking panels. The second end of a brace member is operatively coupled to the panel connection member.

Another embodiment of the invention is a structure comprising a plurality of support members, a plurality of joists operatively coupled to one or more of the plurality of support members, one or more decking panels operatively coupled to the plurality of joists, and one or more brace members. Each of the one or more brace members having a first end and a second end. The first end is operatively coupled to a joist of the plurality of joists and the second end is operatively coupled to a panel of the one or more the decking panels between two adjacent joists.

In further accord with embodiments of the disclosure, the plurality of joists, the one or more decking panels, and the one or more brace members are pre-formed into a panelized system. The panelized system is lifted for operative coupling to two or more support members of the plurality of support members of the structure.

In other embodiments, the plurality of joists lack cross-bracing and horizontal bracing between adjacent joists of the plurality of joists.

Another embodiment of the invention is a method for building a structure. The method comprises assembling one or more decking panels to a plurality of joists, and assembling one or more brace members to the one or more decking panels and the plurality of joists. The one or more brace members each have a first end and a second end. The first end of a brace member is operatively coupled to a joist of the plurality of joists and the second end of the brace member is operatively coupled to a panel of the one or more decking panels between two adjacent joists.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Figure 1:
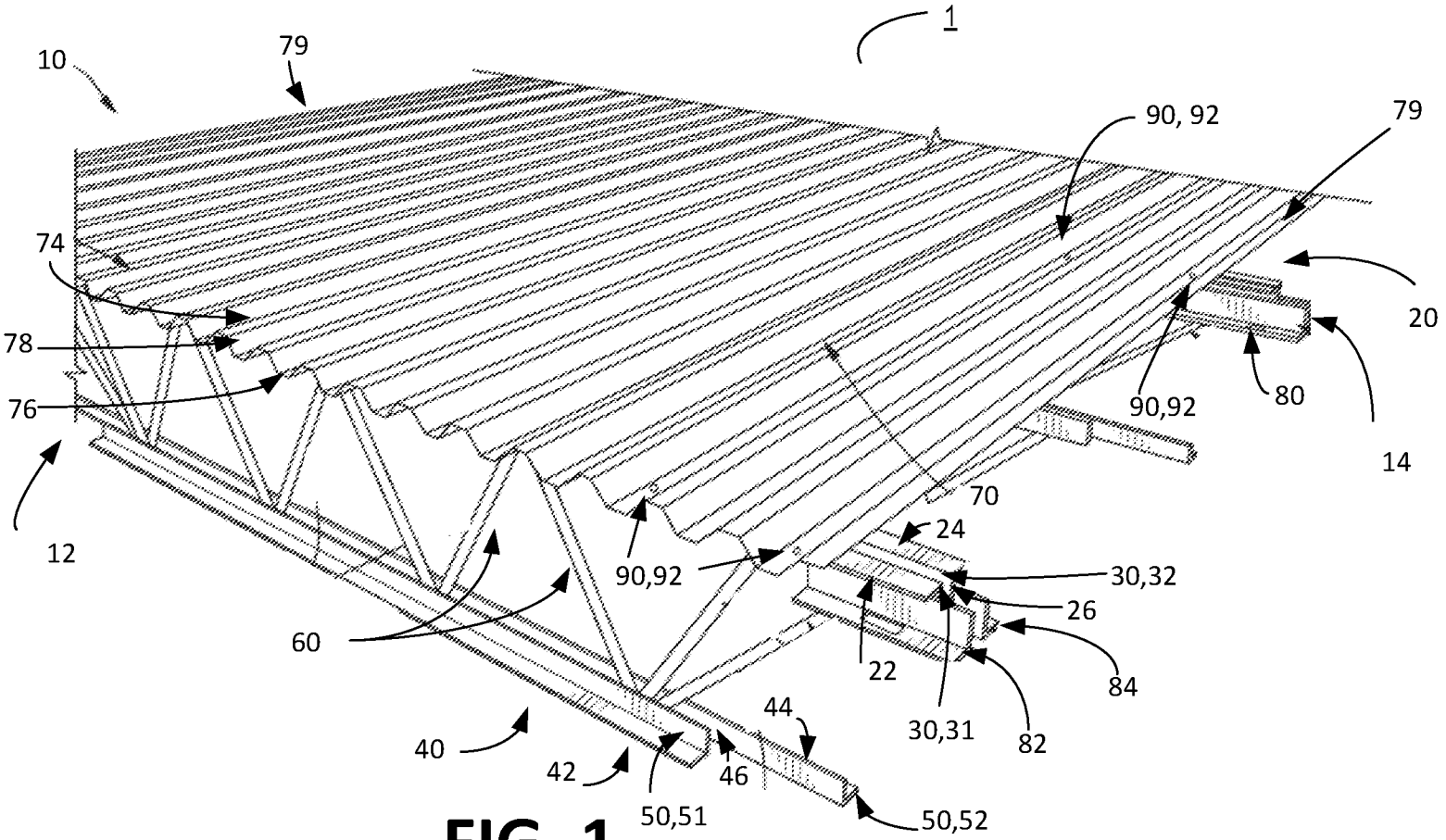
FIG. 1 illustrates a perspective view of a panelized system, in accordance with some embodiments of the disclosure.

Embodiments of the present invention may now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

As discussed, "support members", as used herein, may refer to structural wall, roof, or floor structures or components that are used in construction of buildings, such as commercial or industrial construction, residential construction. In some embodiments, support members refer to one or more of primary support members of a building, such as those that provide support for the floors and/or ceilings (e.g., beams, joist girders, purlins, masonry walls, concrete walls, cold-formed wall studs, wood load bearing wall studs, trusses, frames, columns and/or the like). The support members may be manufactured from metals, alloys, non-metals, natural materials (e.g., wood, or the like), composites, and/or combinations thereof, and may comprise suitable cross-sections, shapes, and dimensions.

In some embodiments, decking panels are operatively coupled to the plurality of joists on the ground in order to form a panelized system. The panelized system comprises the plurality of joists (e.g., two or more joists), the structural decking panels, and the bracing members that may be pre-assembled before being lifted and installed onto a structure having one or more support members. In particular embodiments, the panelized system is made from steel decking panels, steel joists, and steel bracing members. However, in other embodiments, the decking panels, the joists, and the bracing members may be made out of other materials, such as composites, wood, other metals, combinations thereof, or the like. The panelized system is coupled to the structure (e.g., one or more support members, such as beams, columns, walls, or the like horizonal and/or vertical support members) and/or other panelized systems to form the structural decking system (e.g., building or the like). The present invention provides optimal (e.g., equivalent, enhanced, or the like) uplift and rollover capacity for these panelized systems, without adding undue time intensive and expensive construction and assembly steps.

In particular, the present invention provides the ability to quickly install bracing members in a panelized system directly between joists and the decking panels, without the need to utilize cross-bracing and/or horizonal bracing between adjacent joists. That is, the length and number of bracing members used in the present invention can be greatly reduced, thus reducing the amount of steel needed to assemble the panelized system (and thus, the building), as well as reducing the time to install the bracing members. These improvements to the panelized system and method of installation reduces the costs while providing the support to aid in resisting rollover of the joists of the panelized system during installation. In some embodiments, the panelized systems of the present invention provide the same uplift and rollover capacity in comparison with structures having cross-bracing and/or horizontal bracing spanning adjacent joists, while providing improved assembly, costs, and efficiency.

Figure 2:
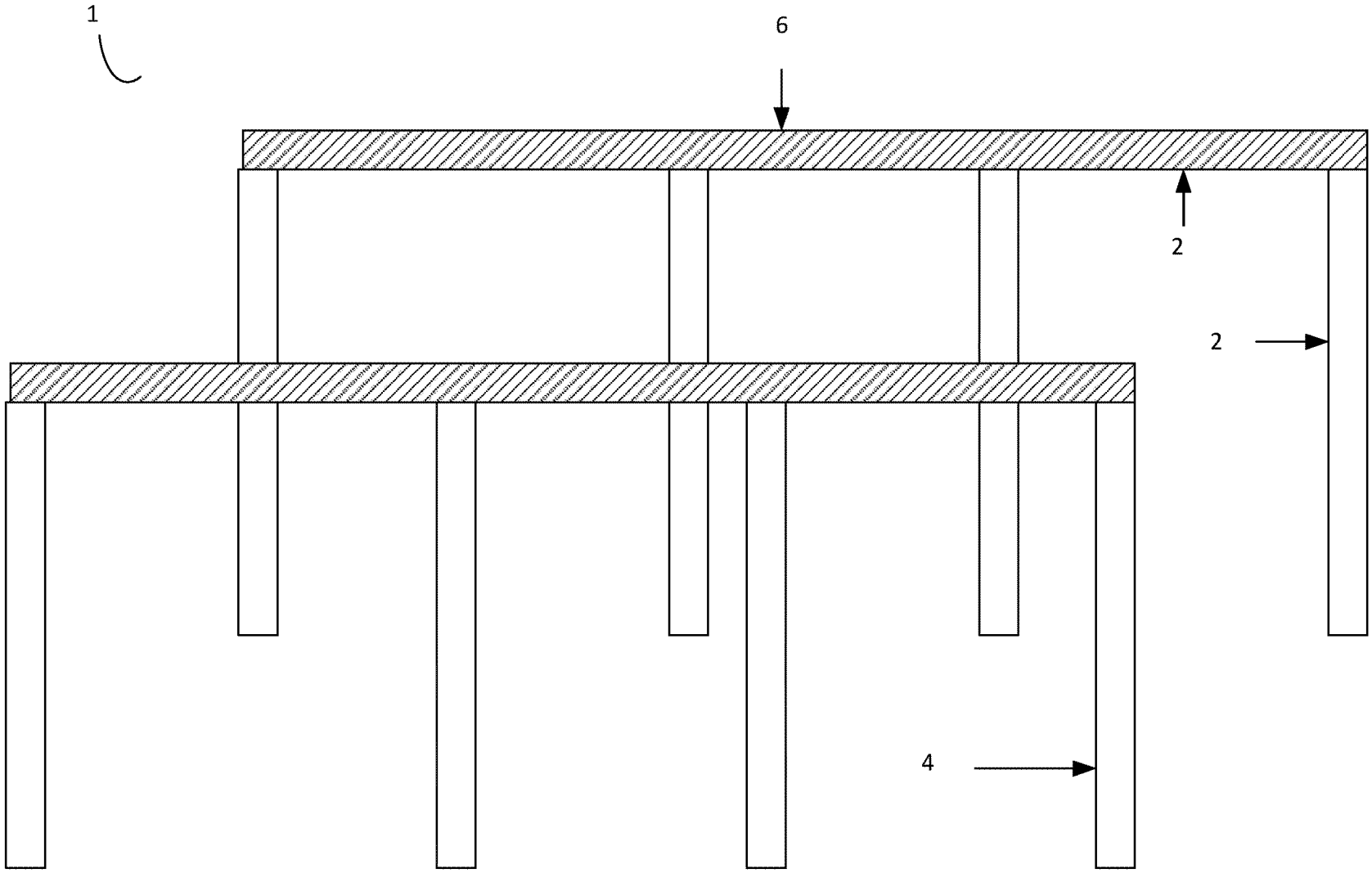
FIG. 2 illustrates a perspective view of a portion of a building structure including vertical support members and horizonal support members, in accordance with some embodiments of the disclosure.

FIG. 1 illustrates a perspective view of a panelized system 10 for a structural decking system, in accordance with some embodiments of the invention. The structural decking system typically comprises a structure 1 (e.g., building, or other structure) having one or more support members 2 (illustrated in FIG. 2) and a panelized system 10 (illustrated in FIG. 1). In some embodiments, the one or more support members 2 of the structure 1 may comprise vertical support members 4, such as beams, columns, walls, or the like support members (illustrated by FIG. 2). The one or more support members 2 may further comprise horizonal support members 6, such as girders (e.g., beam girders, joists girders, or like), or the like (illustrated in FIG. 2). In some embodiments, the panelized system 10 comprises a plurality of joists 12, a plurality of joist seats 14 (otherwise described a joist shoes), one or more structural decking panels 70, and/or brace members 100 (illustrated in FIG. 3) that are operatively coupled to the joists 12 and the decking panels 70. Typically, the panelized system 10 is operatively coupled to a pair of the support members 2 using one or more joists 12 extending between the support members 2, through the use of one or more joist seats 14 for each joist 12, (e.g., when the panelized system 10 having the joists 12 is lifted onto the structure having the support members 2).

The joists 12 may be any type of joist; however, in the illustrated embodiment the joists 12 are open web joists. The joists 12 may comprise an upper chord 20 and a lower chord operatively coupled by webs 60. The upper chord 20 and lower chord 40 may each comprise first members and second members operatively coupled together. For example, the upper chord 20 may comprise a first upper member 22 operatively coupled to a second upper member 24. In some embodiments, the first upper member 22 and the second upper member 24 are operatively coupled together through the use of a spacer 26. The spacer 26 may be any type of spacer 26, such as a cylindrical, square, rectangular, or other type of spacer 26 that separates the first upper member 22 from the second upper member 24 to create a gap between the first upper member 22 and the second upper member 24. As will be described herein, in some embodiments, the spacer 26 is not necessary, and instead the webs 60 space the first upper member 22 from the second upper member 24, as will be described in further detail herein. As previously discussed, the first upper member 22 and the second upper member 24 may be angle members (e.g., L-shaped) such that the first upper member 22 and the second upper member 24 comprise legs 30 (e.g., proximal legs 31 and distal legs 32). The proximal legs 31 may each have inner surfaces to which the webs 60 may be operatively coupled.

The lower chord 40 may comprise a first lower member 42 operatively coupled to a second lower member 44. In some embodiments, the first lower member 42 and the second lower member 44 are operatively coupled together through the use of a spacer 46. The spacer 46 may be any type of spacer 46, such as a cylindrical, square, rectangular, or other type of spacer 46 that separates the first lower member 42 from the second lower member 44 to create a gap between the first lower member 42 and the second lower member 44. As will be described herein, in some embodiments, the spacer 46 is not necessary, and instead the webs 60 space the first lower member 42 from the second lower member 44. As previously discussed, the first lower member 42 and the second lower member 44 may be angle members (e.g., L-shaped) such that the first lower member 42 and the second lower member 44 comprise legs 50 (e.g., proximal legs 51 and distal legs 52). The proximal legs 51 may each have inner surfaces to which the webs 60 may be operatively coupled.

The webs 60 (e.g., angle members, bars—of any shape or size, or the like) are used to operatively couple the upper chord 20 to the lower chord 40 and provide structural support to the joists 12. The webs 60, like the members of the chords 20, 40 may have a proximal leg 61 and a distal leg 62. As such, the webs may have an L-shape. However, it should be understood that the webs 60 may be any shape, such as C-shaped, square, rectangular, round, oval, any polygonal shape, non-uniform, or the like and/or may be partially or completely hollow and/or solid. The webs may be operatively coupled to the upper chord 20 and/or lower chord 40 through any connector, such as a weld, clip, clamp, fastener (e.g., bolts, nuts, screws, or the like), or any other type.

As further illustrated in FIG. 1 the joist 12 may comprise a joist seat 14, which comprises a portion of the upper chord 20 that is operatively coupled to a seat chord 80 (e.g., a second chord that mates with the upper chord 20). It should be understood that the upper chord 20 may be operatively coupled directly to the seat chord 80 as illustrated in FIG. 1, or it may be spaced apart from the seat chord 80 through the use of one or more webs 60. Moreover, each of the joist seat(s) 14 may comprise one or more angle portions 82, 84, which may be operatively coupled to each other via a seat component (e.g., a joist seat plate, portion of one of the joist between them, or the like). The angle portions 82, 84 may comprise a suitable cross-section, such as a substantially "C" shaped, a "L" shaped, a "V" shape, "U" shape, or the like. In the embodiment illustrated in FIG. 1, each of the angle portions 82, 84 of the joist seat(s) 14 comprise an "L" shape. As such, the angle portions 82, 84 are operatively coupled to each other and to an upper chord 20 (e.g., also comprising of two "L" shaped angles, or the like). In some embodiments it should be understood that the upper chord 10 may not utilize a seat chord 80, and as such the upper chord 20 may be operatively coupled to one or more support members 4, 6 directly or through other members.

The decking panels 70 of the structural panel system 1 may be operatively coupled to the joists 12 and/or each other through the use of one or more connectors 90 (e.g., panel connectors 92). It should be understood that the structural decking panels 70 may have profiles that include top flanges 74 (otherwise described as peaks, upper flanges, outer flanges, or the like), bottom flanges 76 (otherwise described as troughs, lower flanges, inner flanges, or the like), and panel webs 78 (e.g., the portions of the panel that are sloped, perpendicular, or generally perpendicular with the flanges 74, 76) that operatively couple the top flanges 74 to the bottom flanges 76. The combination of top and bottom flanges 74, 76 (or portions of the bottom flanges 74, 76), and the panel webs 78 create a flute for the decking panels 70 that may be described as profiles. The profiles may be referred to as "fluted profiles," "hat profiles", "flat-bottomed profiles", "triangular profiles," "trapezoidal profiles," "dovetail profiles," or other like profiles depending on the shape of the profiles. The distance from the top of the top flange 74 and the bottom of the bottom flange 76 may generally range from a ½ inch to 3, 3½, 4, 4½, 5, 5½, or the like inches in depth; however, other ranges of depths within these ranges, overlapping these ranges, or outside of these ranges may be used in the profiles. For example, in some embodiments this distance may range from ½ inch to 12 inches in depth, or the like. The decking panels 70 may or may not include longitudinal ribs, bends, or cutouts that impact the moment of inertia and section modulus of the decking panels 70 (e.g., profile dimensions, ribs, cutouts, or the like that are used to target different performance characteristics, such as but not limited to strength and/or stiffness). Depending on the material thickness, the length and width of the decking panels 70, and the height of the top flanges 74 and bottom flanges 76, the decking panels 70 may weigh between 100 and 420 lbs. In other embodiments, the weight of the decking panels 70 may be within, overlap, or be located outside of this range. Each decking panel 70 may be formed (e.g., roll-formed, or the like) into the desired profile.

Decking edges 79 (e.g., the opposite longer sides of the structural decking panel 70) may be formed into lips that couple a first decking panel 70 to an adjacent second decking panel 70. The lips on opposite edges 79 of a decking panel 70 may create sidelaps between the decking panels 70. The sidelaps may be overlapping in-plane sidelaps, out of plane sidelap seams (e.g., male and female standing lips that create a standing sidelap seam), in-plane nested sidelaps, or the like. The sidelaps may have two, three, four, or more layers, or the like. Connectors 90 (also described as joints, couplings, attachments, or the like) may be formed in the sidelap of the structural decking panels 70 to couple adjacent decking panels 70 to each other using fasteners (e.g., bolts, rivets, screws, or the like), welds (e.g., top sidelap welds, side sidelap welds, or the like), interference clench connections (e.g., cut, sheared, punched, deformed, or the like), or the like as discussed herein.

In order to couple two adjacent structural decking panels 70 together, a first edge of a first structural decking panel 70 may receive a second edge of a second structural decking panel 70. The first edge may be placed over the second edge to create an un-joined sidelap 70 along the length of adjacent structural decking panel edges 79. The purpose of the sidelap 79 formed after coupling (e.g., utilizing a connector 90, such as a fastener, interference clench connection, weld, or the like) is to couple two adjacent structural decking panels 70 securely to each other in order to prevent one decking panel 70 from separating transversely from another decking panel 70 (e.g., lifting vertically off another panel in a horizontal roof or floor installation), preventing in-plane movement (e.g., shifting of the panels along the sidelap) between the adjacent structural panels 70, and providing the desired shear strength of the structural system 1.

In the panelized system 10, the structural decking panels 70 may be secured to the joists 12, after the decking panels 70 have been placed over the joists 12, through one or more panel connectors 92 as previously discussed herein. In some embodiments, it should be understood that the panel connectors 92 may be one or more fasteners that operatively couple the decking 70 to the joists 12 (e.g., joist connectors). For example, a fastener may extend through the decking 70 (e.g., bottom flange 76 of the decking) and to the upper chord 20 of the joist 12 (e.g., a first member 22 or a second member 24).

When utilizing a panelized system 10 having joists 12 and decking panels 70, the panelized system 10 may be prone to rollover in a direction perpendicular to the length of the joists due to forces (e.g., wind, or the like) acting on the panelized system 10 as it is being lifted and/or installed onto the support members 2 of the structure. Typically, cross-bracing and/or horizontal bracing between the joists is used (e.g., multiple cross-bracing in an x-shaped pattern, horizontally between the same components of two adjacent joists, or the like) to connect adjacent joists (e.g. the top chord of one joist and the bottom chord of another joist, the top chords of adjacent joists, the bottom chords of adjacent joists, webs of adjacent joists, or the like) together in order to resist rollover of the joists 12 during lifting and installation of the panelized system 10 and/or other forces (e.g., wind uplift forces after lifting, during or after installation, or the like). Typically, the bracing extends the entire length between adjacent joists so that they bear on each other to prevent rollover. Installation of the braces is time consuming and expensive, as it requires a significant amount of bracing materials, usually steel angles, and must be attached by welding, fasteners, or the like on both ends of each brace. Alternatively, the present invention provides a system of bracing the joist directly to the decking, such as, a bottom chord of the joist directly to the decking, in order to resist rollover while eliminating bracing.

Figure 3:
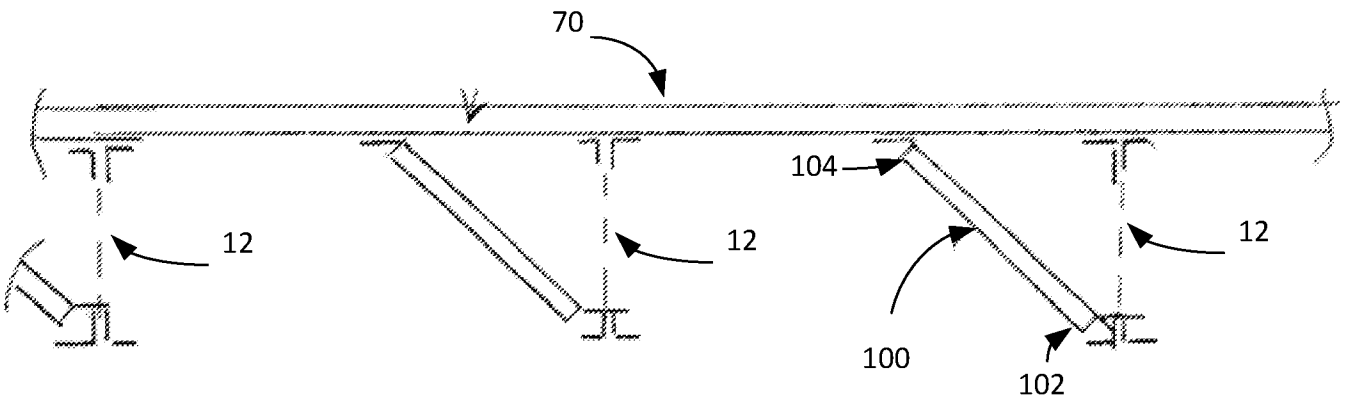
FIG. 3 illustrates a cross-sectional side view of a panelized system, in accordance with some embodiments of the disclosure.

As illustrated in FIGS. 3 through 6G, bracing members 100 may be utilized to operatively coupled a joist 12 to a portion of the one or more decking panels 70. In the illustrated embodiments, the bracing members 100 have a first end 102 and a second end 104. The first end 102 of the bracing members 100 are operatively coupled to the joist 12, such a lower chord 40 of the joist 12, as will be explained in further detail herein. However, it should be understood that the first end 102 of the maybe operatively coupled to the webs 60, upper chord 40, or the like. Alternatively, the second end 104 of the bracing members may be operatively coupled to the decking panel 70, such as to any portion of the decking panel 70 located between adjacent joists 12. In some embodiments, the decking panel 70 is located at approximately the mid-point; however, it should be understood that the bracing members 100 may be operatively coupled to any location of the decking panels 70 between two joists (e.g., +/−5, 10, 15, 20, 25, 30, 35, 40, 45, 50, or the like percent of the distance to the mid-point). As illustrated in FIG. 3, multiple bracing members 100 may be installed extending in the same direction between different joists 12; however, in other embodiments bracing members 100 may be installed such that they extend in different directions between joists 12. Moreover, multiple bracing members 100 may be installed on a single joist 12 (e.g., lower chord 40 of the joist 12) in the same direction and/or in different directions (e.g., to the right and/or left of a joist 12).

The bracing members 100 may have any type of shape, such as but not limited to an L-shape having a first leg 106 and a second leg 108. In some embodiments the first leg 106 and the second leg 108 may form the angle member (e.g., L-shaped member). However, it should be understood that the bracing members 100 may have circular, square, rectangular, triangular, U-shaped, C-shaped, non-uniform, and/or other like shape. The bracing members 100 may have one or more apertures 109 (e.g., apertures in the first leg 106, second leg 108, one or more brace connection members 110, or the like of the bracing members 100) in order to operatively couple the bracing members 100 to the joists 12 and/or decking panels 70.

Figure 4A:
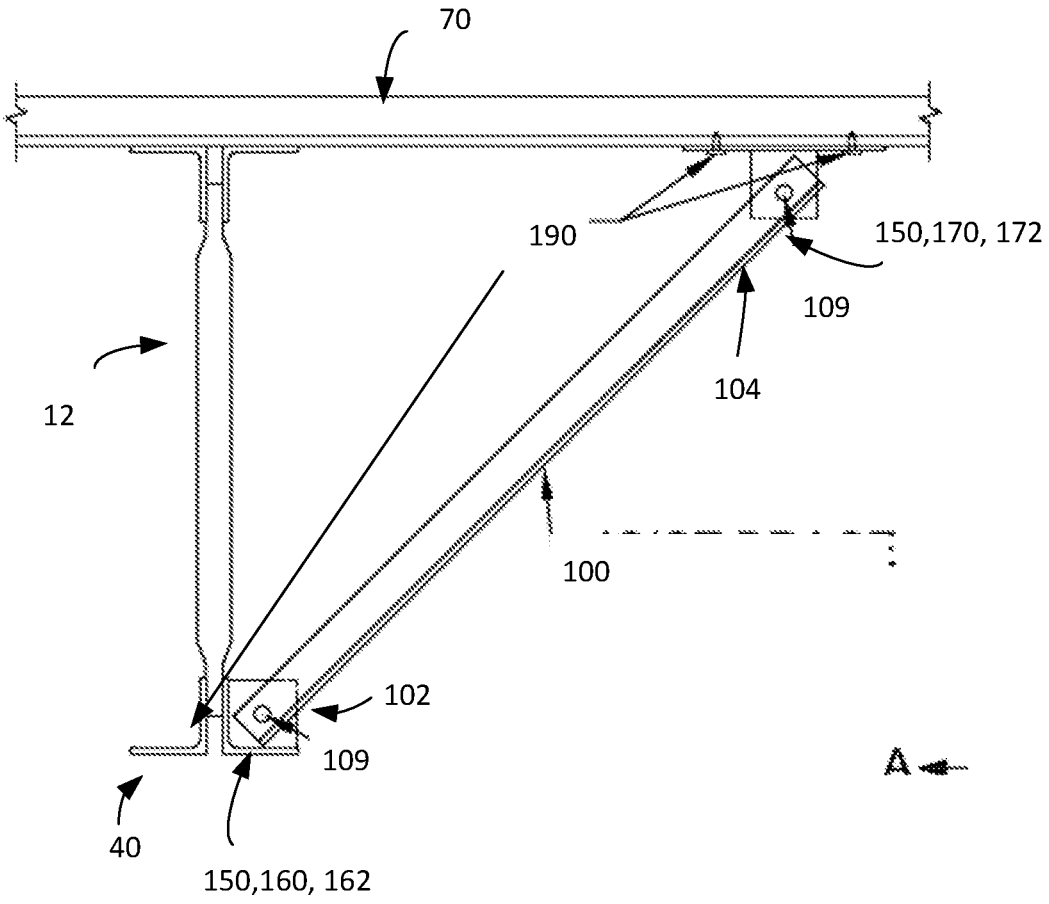
FIG. 4A illustrates a cross-sectional enlarged side view of a bracing member of a panelized system, in accordance with some embodiments of the disclosure.
Figure 4B:
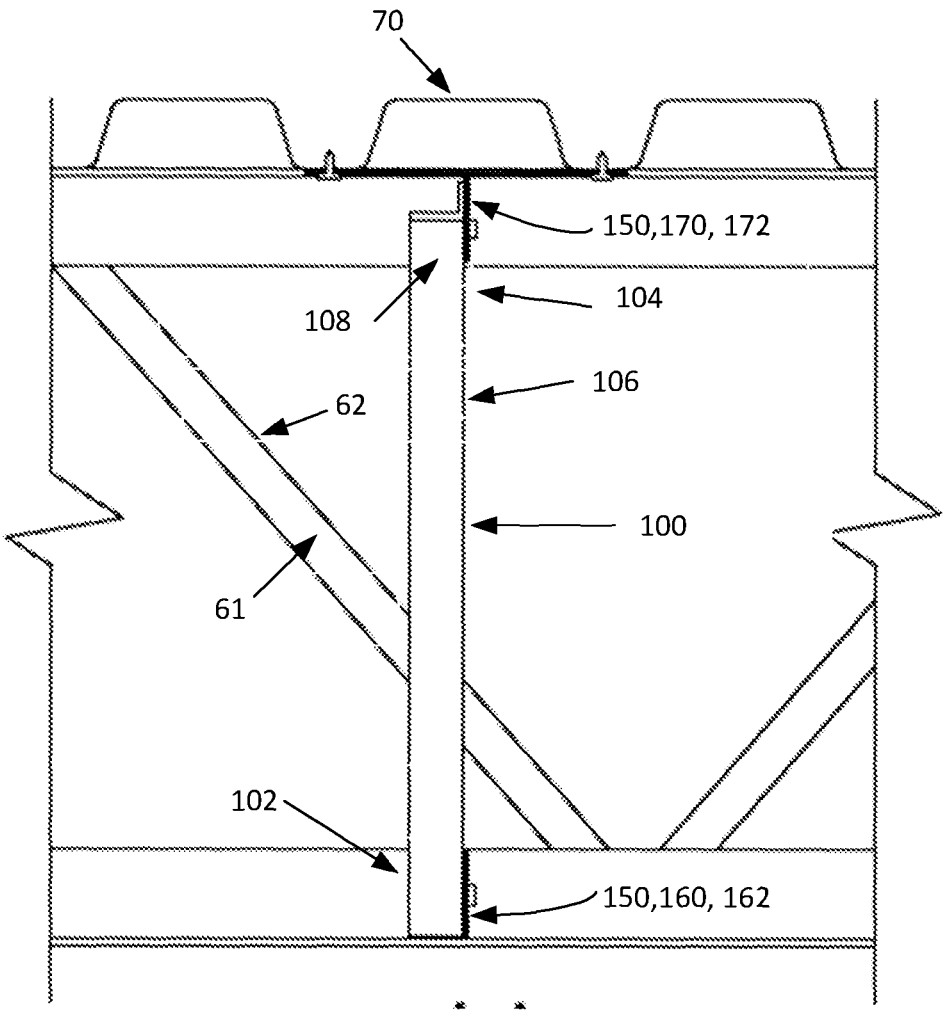
FIG. 4B illustrates a cross-sectional enlarged end view of a bracing member of a panelized system, in accordance with some embodiments of the disclosure.

As illustrated in FIGS. 4A through 5C, in some embodiments, the bracing member 100 may be installed using one or more connection members 150 (e.g., joist connection members 160, panel connection members 170), such as brackets, clips, angles, or the like. As illustrated in FIGS. 4A and 4B, in some embodiments the joist connection members 160 may be a joist brace bracket 162, and the panel connection members 170 may be a decking brace bracket 172. For example, the joist brace bracket 162 may be operatively coupled to the joist 12, such as a portion of the lower chord 40 of the joist 12. That is, the joist brace bracket 162 may be operatively coupled to the joist using a connector 190 (e.g., welded, clamped, clipped, fastened using fasteners, or the like) in order to provide a mounting location for the first end 102 of the bracing members 100. Alternatively, and/or additionally, the decking brace bracket 172 may be operatively coupled to the decking panel 70 using connectors 190 (e.g., welded, clamped, clipped, fastened using fasteners, or the like) to provide a mounting location for the second end 104 of the bracing members 100. For example, the decking brace bracket 172 may be fastened to the decking panels 70 using the connectors 190.

Figure 5A:
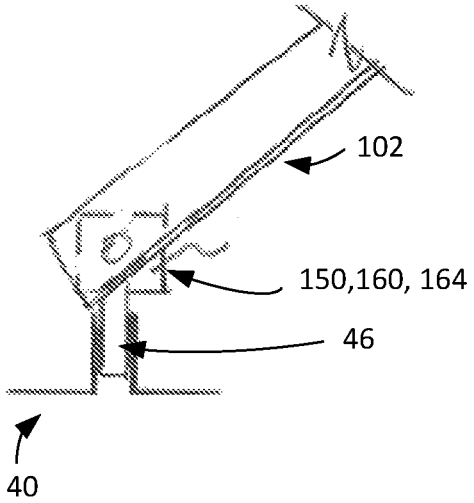
FIG. 5A illustrates an enlarged side view of a bracing member having an alternate joist connection member, in accordance with some embodiments of the disclosure.

In alternate embodiments of the invention, as illustrated in FIG. 5A, the joist connection members 160 may be a joist brace clip 164. The joist brace clip 164 may be a paddle clip that includes a plate member and/or a spacer 46 that is operatively coupled between and/or to one or more of the inner surfaces of a chord, such as the inner surfaces of the proximal legs 51 of the lower chord 40 (e.g., a first lower member 42 and a second lower member 44).

Figure 5B:
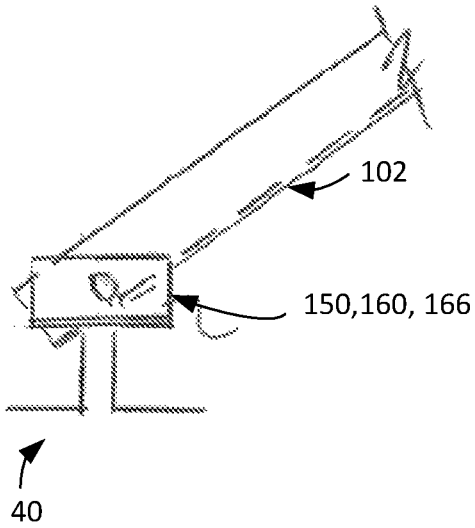
FIG. 5B illustrates an enlarged side view of a bracing member having an alternate joist connection member, in accordance with some embodiments of the disclosure.

In alternate embodiments of the invention, as illustrated in FIG. 5B, the joist connection members 160 may be an joist angle member 166. The joist angle member 166 may be similar to the members of the chords 30, 40 and/or webs 60, that is, having a proximal leg and a distal leg, and potentially crossing transversely across the chords 30, 40, and/or webs 60 (as illustrated with respect to the lower chord 40 in FIG. 5B). It should be understood that while the joist connection members 160 are illustrates as plates and/or angle members it should be understood that the joist connection members 160 may be any type of shape having any type of cross-section (e.g., triangular, square, rectangular, oval, circular, polygonal, uniform, non-uniform, or the like).

Figure 5C:
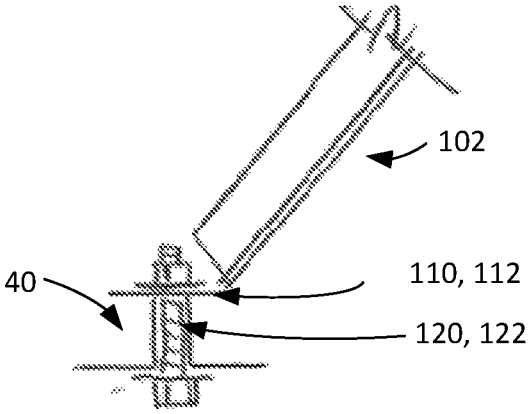
FIG. 5C illustrates an enlarged side view of a bracing member having a brace connection member, in accordance with some embodiments of the disclosure.

In other alternate embodiments, as illustrated in FIG. 5C, and as will be described in further detail with respect to FIGS. 6A and 6B, the brace member 100 may include a brace connection member 110.

In alternate embodiments of the invention, the bracing members 100 may be operatively coupled to the joist 12 and decking panels 70 (e.g., with or without the need for a joist connection members 160, panel connection member 170, or the like). For example, as illustrated in FIGS. 6A through 6G, the bracing members 100 may comprise one or more brace connection members 110, such as one or more first brace connection members 112 (e.g., first brace flange, or the like) for operative coupling with the joist 12, and/or one or more second brace connection members 114 (e.g., second brace flange, or the like) for operatively coupling with the panels 70. The one or more brace connection members 110 (e.g., flanges, or the like) may have apertures 116 (e.g., pre-formed apertures, apertures that are formed from a self-drilling fastener, or the like) that may be used for operatively coupling the brace connection members 110 with the joist 12 and/or decking panel 70, respectively. The one or more brace connection members 110 (e.g., first brace connection member 112, second brace connection member 114, or the like may comprise flanges that may be flat plates that extend from the first end 102 and/or the second end 104 of the brace members 100.

Figure 6A:
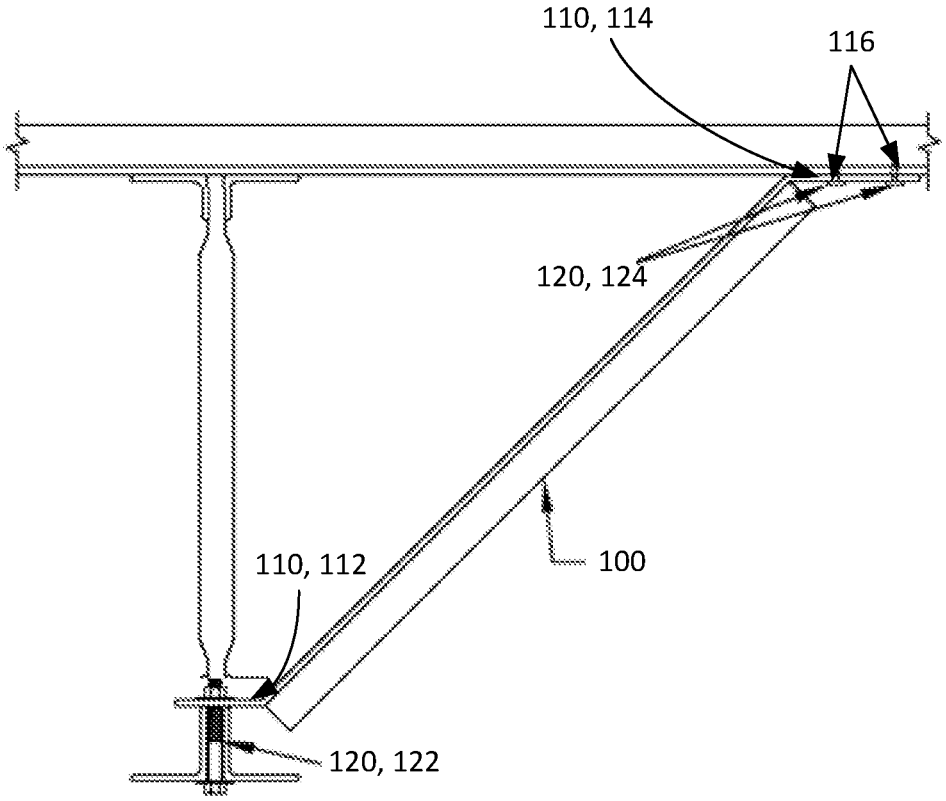
FIG. 6A illustrates a cross-sectional enlarged side view of a bracing member of a panelized system having brace connection members, in accordance with some embodiments of the disclosure.
Figure 6C:
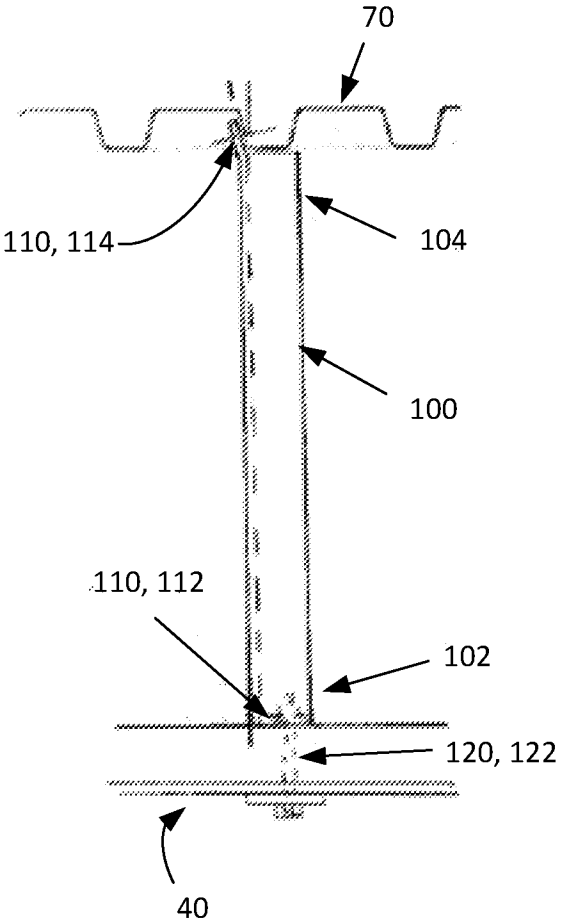
FIG. 6C illustrates a cross-sectional enlarged end view of the bracing member of FIG. 6B having the alternate brace connection member, in accordance with some embodiments of the disclosure.
Figure 6B:
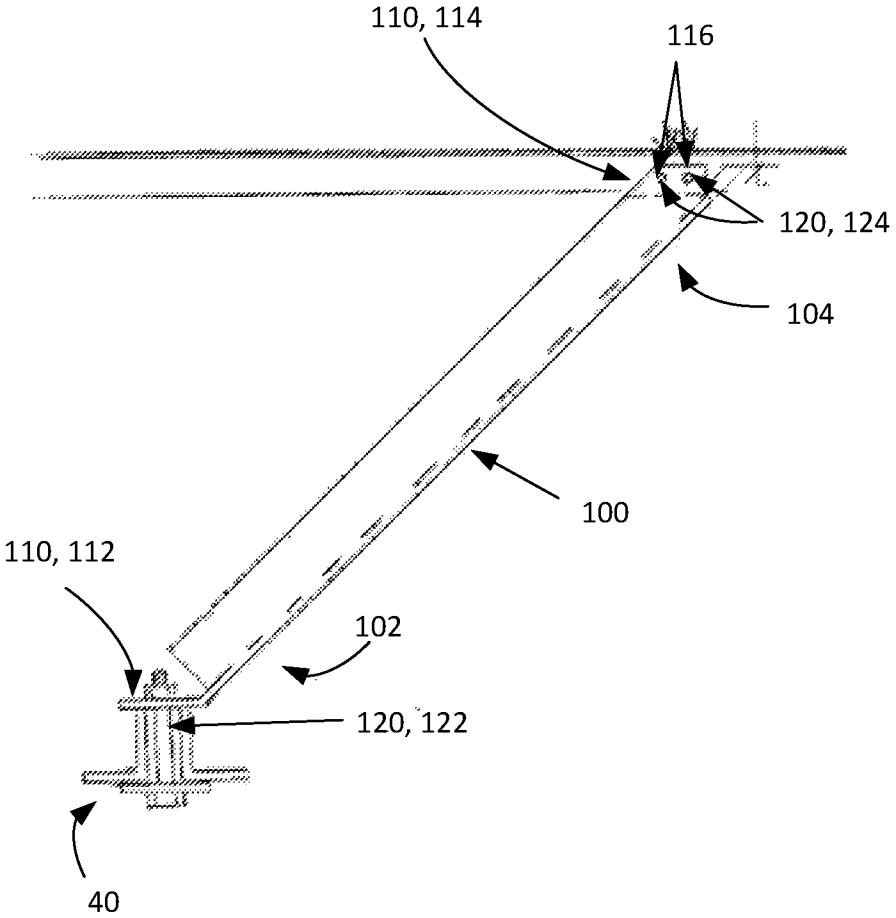
FIG. 6B illustrates a cross-sectional enlarged side view of a bracing member of a panelized system having an alternate brace connection member, in accordance with some embodiments of the disclosure.
Figures 6D, 6E:
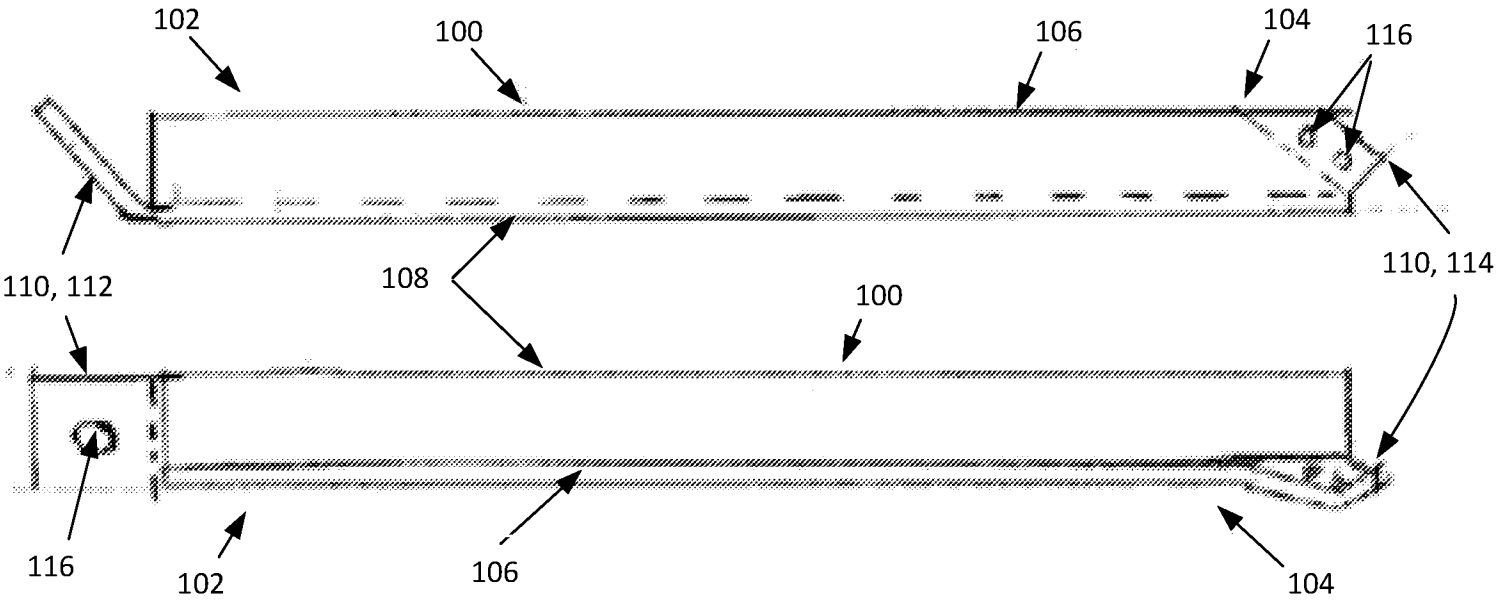
FIG. 6D illustrates a side view of the bracing member of FIGS. 6B and 6C, in accordance with some embodiments of the disclosure.
FIG. 6E illustrates a side view the bracing member of FIGS. 6B and 6C, in accordance with some embodiments of the disclosure.
Figure 6F:
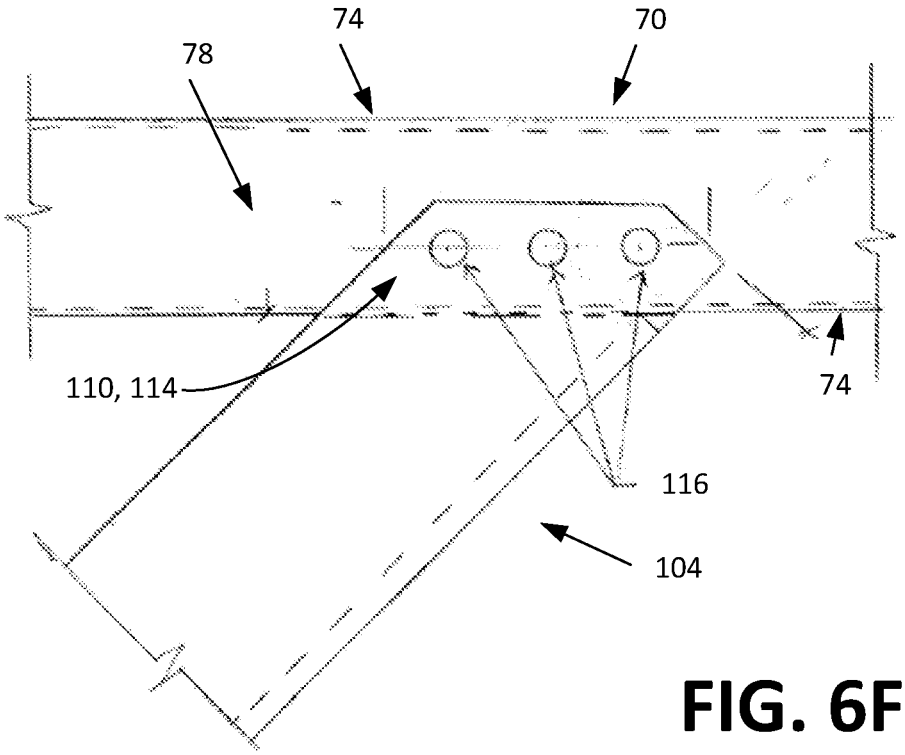
FIG. 6F illustrates an enlarged side view of the alternate brace connection member of FIG. 6B, in accordance with some embodiments of the disclosure.
Figure 6G:
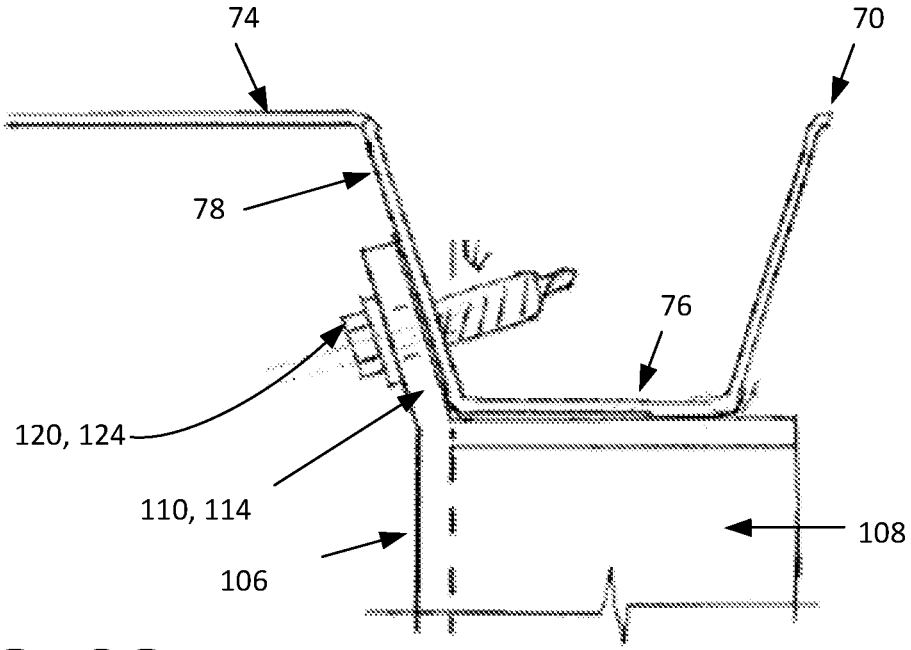
FIG. 6G illustrates an enlarged end view of the alternate brace connection member of FIG. 6C, in accordance with some embodiments of the disclosure.

It should be understood that the brace connection members 110 may be parallel with each other, as illustrated in FIG. 6A, or may have different angles, as illustrated FIGS. 6B through 6G. As such, as illustrated in FIG. 6A, the second brace connection member 114 may be operatively coupled the lower flange 76 of a flute of a decking panel 70 (e.g., in some embodiments be parallel with the lower flange 76). However, as illustrated in FIGS. 6B through 6G, in some embodiments the second brace connection member 114 may be operatively coupled to a web 78 of a flute of a decking panel 70 (e.g., in some embodiments be parallel with the web 78).

Brace connectors 120 (e.g., welds, clips, hook, clamps, fasteners, such as nuts, bolts, screws, rivets, or the like) may be used to operatively couple the brace members 100 to the joist 12 and/or decking panel 70. For example, as illustrated in FIGS. 6A through 6G, a joist brace fastener 122 (e.g., bolt with a nut, or the like) may be inserted through the joist brace connection member 112 (e.g., through an aperture 116, or the like in a flange, or the like), through the gap between the first lower member 42 and the second lower member 44 of the lower chord 40 of the joist 12, and the fastener 122 may be secured on the underside of the lower chord 40 using a nut (or vice versa on the upper side). As further illustrated in FIGS. 6A though 6G, one or more decking brace connectors 124, such as fasteners (e.g., screws, such as a self-tapping and/or threading screw, or the like) may be inserted through the panel brace connection member 114 (e.g., through an aperture 116, or the like in a flange, or the like) and into the decking panel 70. The one or more panel brace connection members 114 (e.g., decking brace flanges, or the like) may be operatively coupled to the bottom panel flange 76, the top panel flange 74, and/or the panel webs 78.

It should be understood that the use of bracing members 100 that operatively couple the joist 12 to the decking panels 70 allows for use of shorter brace members 100 when compared to cross-bracing (e.g., x-shaped bracing between adjacent joists, or the like) and/or horizontal bracing (e.g., bracing between the same components of adjacent joists, or the like) that extends between joists 12. Moreover, the attachment of the bracing members 100 to the joists 12 and/or the decking panels 70 allows for ease of assembly for installers assembling the panelized system 10 having the bracing members 100. As such, much less steel is needed to create the panelized system 10 when compared to the use of cross-bracing and/or horizontal bracing between two adjacent joists 12. Moreover, assembly time of the panelized system 10 is much less using the bracing members 100 described herein, when compared to assembly times that require cross-bracing and/or horizonal bracing that spans between adjacent joists 12. In addition to the reduction in steel and the reduced assembly time, the bracing members 100 effectively prevent rollover of the joists 12 as the panelized system 10 is being lifted and installed onto the structure (e.g., provide the same, similar, and/or improved rollover resistance) and resist wind uplift forces during or after the panelized system 10 is installed in the structure 1.

It should be further understood that when discussing using the bracing members 100 without the need for cross-bracing and/or horizonal bracing, this may mean without any cross-bracing and/or horizonal bracing at all, or without cross-bracing and/or horizonal bracing that substantially contributes to preventing roll-over and/or resisting uplift forces. For example, in some embodiments should the bracing members 100 be used in combination with cross-bracing and/or horizontal bracing, as between the bracing members and cross-bracing and/or horizontal bracing, the bracing members 100 described herein provide all or the majority of the support for preventing roll-over and/or resisting uplift forces (e.g., 100, 95, 90, 85, 80, 75, 70, 65, 60, 55, 50, or the like percent thereof). As such, it should be understood that in some embodiments of the invention, the structure 1, including the panelized system 10 thereof, may use both the bracing members 100 and cross-bracing and/or horizonal bracing. In this way, the benefits of using the bracing members 100 described herein is still achieved (e.g., reducing materials used, reducing assembly time, or the like), but some cross-bracing and/or horizonal bracing may still be used.

Figure 7:
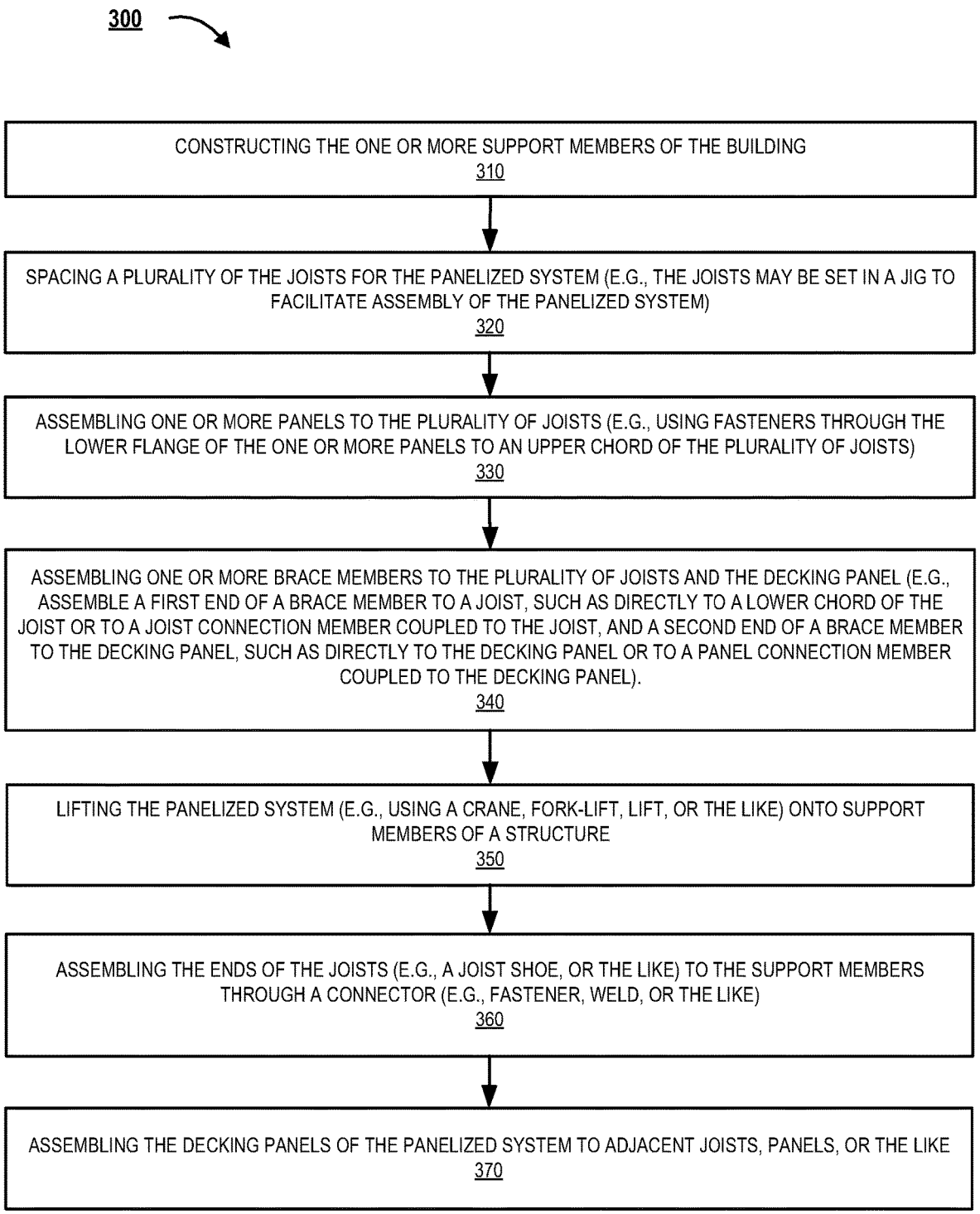
FIG. 7 illustrates a process flow for assembling a panelized system together and to a structure, in accordance with some embodiments of the disclosure.

FIG. 7 illustrates a process flow 300 for a method of assembling one or more panelized systems 10 and/or assembling a structural decking system 1 from the one or more panelized systems 10. As illustrated in block 310, the one or more support members 2 of a structure 1 are assembled. For example, vertical support members 4 (e.g., I-beams, reinforced concreate columns, walls, or other like members) are secured to the ground (e.g., earth, foundations, or the like). Moreover, horizonal support members 6 (e.g., girders, or the like) are secured to the vertical column members 4.

Moreover, a plurality of joists may be assembled off-site and delivered to a building site, can be at least partially assembled on site, or may be completely assembled on site. As illustrated in block 320 of FIG. 7, in some embodiments, the plurality of joists 12 are spaced apart from each other, such as in one or more jigs in order to assemble the panelized system 10 (e.g., the plurality of joists 12 are positioned, situated, and/or at least partially coupled to the jig). The jig may be adjustable to account for different sizes and/or configurations of a panelized system 20 (e.g., adjusted for the distance between joists 12, adjusted for length and/or height of the joists 12, adjusted for different joists within the same panelized system 10, or the like). The jig may allow for proper positioning of the joists 12 as they will be installed on the structure. The jig may also be moveable or located in a particular area of the site to improve lifting and installation of the panelized system 10. As such, at least some of the plurality of joists 12 may be panelized in a jig such that the joists 12 are positioned and situated in locations that would correspond to support members 2 of a structure when the panelized system 10 is lifted onto the structure 1.

It should be understood that in some embodiments different types of joists may be required in different locations within the structure, such as joists 12 that are assembled over vertical support columns in the building. For example, joists that are connected to columns may have different structural requirements when compared to joists that are not located at columns. The joists that may be required at column locations may be either end joists or intermediate joists depending on where each panelized system 10 is being installed in the structure. As such, some joists 12 may be different than other joists. Alternatively, in some embodiments all of the joists 12 within a panelized system 10 may be the same. Consequently, the jig may allow for the assembly of joists 12 that are the same or different from each other.

Block 330 of FIG. 7 illustrates that one or more panels 70 are assembled to the plurality of joists 12 (e.g., the joists 12 located in the jig). For example, the panels 70 overlay the upper chord 20 of the joist 12 and the panel connectors 92 may be utilized to operatively couple the panels 70 to the upper chord 20 of the joists 12 (e.g., a fastener that extends through the panel into the upper chord 20, or the like). Furthermore, adjacent structural panels 70 may be operatively to each other using a suitable joining method (e.g., using a panel connector, such as fasteners, welding, shearing a sidelap, or the like). Alternatively, or in addition, to assembling the structural decking panels 70 before lifting the panelized system 10, it should be understood that some of the structural decking panels 70 may be installed after lifting the panelized system into place, either before, after or during operative coupling of the joists 12 to the one or more support members 2 (as is indicated by block 360 later on).

FIG. 7 further illustrates in block 340 that one or more brace members 100 are operatively coupled to the plurality of joists 12 and to the panels 70. For example, a first end 102 of a brace member 100 is operatively coupled to a portion of the joist 12. As illustrated in FIGS. 4A through and 5B, in some embodiments, the bracing member 100 may be installed using one or more connection members 150, such as one or more joist connection members 160 (e.g., brackets, clips, angles, or the like) on the joists 12 and/or one or more panel connection members 170 (e.g., brackets, clips, angles, or the like) on the panels 70. For example, the joist connection member 160 may be operatively coupled to the joist 12, such as a portion of the lower chord 40 of the joist 12. That is, the joist connection member 160 may be operatively coupled to the joist 12 using a connector 190 (e.g., welded, clamped, clipped, fastened using fasteners, or the like) in order to provide a mounting location for the first end 102 of the bracing members 100. Alternatively, and/or additionally, the panel connection member 170 may be operatively coupled to the decking panel 70 using a connector 190 (e.g., welded, clamped, clipped, fastened using fasteners, or the like) to provide a mounting location for the second end 104 of the bracing members 100. For example, the panel connection member 170 may be fastened to the decking panels 70 using the connectors 190.

In alternate embodiments of the invention, the bracing members 100 may be operatively coupled to the joist 12 and decking panels 70 directly (e.g., without the need for connection members 150). For example, as previously discussed with respect to FIGS. 6A through 6G, the brace members 100 may comprise one or more brace connection members 110 (e.g., flanges, or the like), such as a first brace connection member 112 (e.g., a first brace flange, or the like) and a second brace connection member 114 (e.g., a first brace flange, or the like). The one or more brace connection members 110 may have apertures 116 (e.g., pre-formed apertures, apertures that are formed from a self-drilling fastener, or the like) that may be used for operatively coupling the brace connection members 110 with the joist 12 and/or decking panel 70, respectively. The brace connectors 120 may be used to operatively the brace members 100 to the joist 12 and/or decking panel 70. For example, as previously discussed with respect to FIGS. 6A though 6B, a joist brace fastener 122 (e.g., bolt with a nut, or the like) may be inserted through the joist brace flange 112 (e.g., through an aperture, or the like), through the gap between the first lower member 42 and the second lower member 44 of the lower chord 40 of the joist 12, and the fastener 122 may be secured on the underside of the lower chord 40 using a nut (or vice versa). Moreover, as previously described with respect to FIGS. 6A through 6B, one or more decking brace fasteners 124 (e.g., screws, such as a self-tapping and/or threading screw, or the like) may be inserted through the decking brace flange 114 (e.g., aperture 116) and into the decking panel 70. The one or more decking brace flanges 110 may be operatively coupled to the bottom panel flange 76, the top panel flange 74, and/or the panel webs 78.

Block 350 of FIG. 7 further illustrates that the panelized system 10 is lifted (e.g., hoisted) onto the structure 1 (e.g., utilizing a crane, forklift, or the like to lift the panelized assembly onto a structure 1, such as a building). In some embodiments, a spreader bar is employed to attach the joists to the crane, which allows lifting of the panelized system 10 from two or more of the joists (e.g., adjacent the center of the joists, or the like) in order to distribute lifting loads.

FIG. 7 further illustrates in block 360 that after lifting, the ends of the joists 12 (e.g., joist seats 14, or the like) are operatively coupled to the support members 2, such as through welds (e.g., on the toes and/or in the apertures of the joist seat 14 and/or joists 12), fasteners (e.g., bolts, nuts, or the like) through the joist seat 14 and/or joists 12, or the like. In some embodiments, the ends of the joists 12 at the corners of the panelized system 10 may be fastened first for safety, such as through a weld or bolted configuration. As such, the panelized system 10 may be assembled onto the structure 1 by operatively coupling a first joist to a corresponding support member 2 (e.g., one or more horizonal support members 6 of FIG. 2) of the structure 1. In some embodiments, the first joist may be assembled to the support member 2 through the use of a fastener (e.g., bolt, nut, stud, or the like) at an aperture of a joist seat 14 of the first joist. It is contemplated that in other embodiments, the first joist may be assembled through welding (e.g., spot welding, welding the toe, welding the one or more apertures) or other joining processes. Moreover, at least a second joist is operatively coupled to a corresponding support member 2 (e.g., one or more horizonal support members 6 of FIG. 2), in accordance with some embodiments of the invention. In some embodiments, the second joist may be assembled through the use of a fastener (e.g., bolt, nut, stud, or the like) at an aperture of a joist seat 14 of the second joist. It is contemplated that in other embodiments, the second joist may be assembled through welding (e.g., spot welding, welding the toe, welding the one or more apertures) or other joining processes. Operatively coupling the one or more joist seats 14 to the support members 2 provides structural support to allow for installers to walk on the installed panelized system 10 during additional assembly (e.g., assembly of the intermediate joists, additional decking panels 70, and/or additional support members 2). Moreover, operatively coupling the one or more joist seats 14 also provides uplift capacity, shear capacity, and/or other loading capacity with respect to environmental loading (e.g., wind, etc.) during the additional assembly processes.

As illustrated by block 370, the structural decking panels 70 and other components may then be assembled with adjacent panelized systems 10 (e.g., other joists 12, other decking panels 70, or the like) using a suitable joining method (e.g., using fasteners, welding, shearing a sidelap, or the like). It should be understood that the decking panels 70 may be installed before, during, and/or after operatively coupling intermediate joists 12 to the support members 2.

While the invention is described herein with respect to pre-forming panelized systems 10 before lifting the panelized systems 10 into place within a building structure 1, it should be understood that the same concepts described herein (e.g., using the brace members) may also be utilized in other systems assembled in different ways. As such, the method of installation described in FIG. 7 may occur in other ways in order to form the structure 1. For example, the assembling of the one or more brace members in block 340 may be performed after lifting the panelized system 10 described in block 350; after assembly of the ends of the joists 12 (e.g., joist seats 14, or the like) described in block 360; or before, concurrent with, or after the assembling of the decking panels 70 to the joists 12 as described in block 330 and/or assembling of the decking panels 70 to each other as described in block 370. In some embodiments, the individual components may be assembled onto a structure 1 on a component by component basis (e.g., installing each joist into place within the structure 1, then installing the panels 70 and/or the bracing 100, or the like). As such, the one or more components described herein may be assembled as individual components or two or more components that are pre-assembled together in any sequence in order to form the structure 1 described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A system for a structure, the system comprising:

a plurality of joists;

one or more decking panels operatively coupled to the plurality of joists, wherein each decking panel of the one or more decking panels comprise a plurality of flutes, wherein each flute of the plurality of flutes comprise:

a top flange;

at least a portion of a first bottom flange;

at least a portion of a second bottom flange;

a first web operatively coupling the top flange to the first bottom flange; and a second web operatively coupling the top flange to the second bottom flange; and one or more brace members, wherein each brace member of the one or more brace members comprise:

a first end; and a second end;

wherein the first end of the brace member is operatively coupled to a joist of the plurality of joists and the second end of the brace member is directly operatively coupled to the top flange, the first bottom flange, the second bottom flange, the first web, or the second web of a corresponding one of the flutes of the one or more decking panels or through a connection member directly operatively coupled to the top flange, the first bottom flange, the second bottom flange, the first web, or the second web of the corresponding one of the flutes of the one or more decking panels, between the joist of the plurality of joists and an adjacent joist of the plurality of joists.

2. The system of claim 1, wherein the plurality of joists, the one or more decking panels, and the one or more brace members are pre-formed into a panelized system, and wherein the panelized system is lifted for operative coupling to one or more support members of the structure.

3. The system of claim 1, wherein the plurality of joists lack cross-bracing and horizontal bracing between adjacent joists of the plurality of joists.

4. The system of claim 1, wherein the first end of the brace member is operatively coupled to a lower chord of the joist of the plurality of joists.

5. The system of claim 1, wherein the second end of the brace member is directly operatively coupled to the top flange, the first bottom flange, the second bottom flange, the first web, or the second web of the corresponding one of the flutes of the one or more decking panels.

6. The system of claim 1, wherein the second end of the brace member is operatively coupled to the corresponding one of the flutes at a mid-point of the one or more decking panels between the joist of the plurality of joists and the adjacent joist of the plurality of joists.

7. The system of claim 1, wherein the one or more brace members each comprise a L-shaped portion formed from a first leg and a second leg.

8. The system of claim 1, wherein the one or more brace members each comprise:

a first brace connection member adjacent the first end of the brace member.

9. The system of claim 8, wherein the first brace connection member comprises a flange extending from the first end of the brace member.

10. The system of claim 8, further comprising a brace connector extending through the first brace connection member and a chord cavity formed between a first lower chord angle and a second lower chord angle.

11. The system of claim 1, further comprising:

a joist connection member operatively coupled to the joist of the plurality of joists; and wherein the first end of the brace member is operatively coupled to the joist connection member.

12. The system of claim 11, wherein the joist connection member is a bracket, clip, or angle.

13. The system of claim 1, wherein the connection member comprises:

a second brace connection member adjacent the second end of the brace member.

14. The system of claim 13, wherein the second brace connection member comprises a flange extending from the second end of the brace member.

15. The system of claim 13, further comprising:

a brace connector operatively coupling the second brace connection member to the corresponding one of the flutes of the one or more decking panels.

16. The system of claim 1, wherein the connection member comprises:

a panel connection member directly operatively coupled to the top flange, the first bottom flange, the second bottom flange, the first web, or the second web of the corresponding one of the flutes of the one or more decking panels; and wherein the second end of the brace member is directly operatively coupled to the panel connection member.

17. A structure, wherein the structure comprises:

a plurality of support members;

a plurality of joists operatively coupled to one or more of the plurality of support members;

one or more decking panels operatively coupled to the plurality of joists, wherein each decking panel of the one or more decking panels comprises a plurality of flutes, wherein each flute of the plurality of flutes comprise:

a top flange;

at least a portion of a first bottom flange;

at least a portion of a second bottom flange;

a first web operatively coupling the top flange to the first bottom flange; and a second web operatively coupling the top flange to the second bottom flange; and one or more brace members, wherein each brace member of the one or more brace members comprise:

a first end; and a second end;

wherein the first end of the brace member is operatively coupled to a joist of the plurality of joists and the second end of the brace member is directly operatively coupled to the top flange, the first bottom flange, the second bottom flange, the first web, or the second web of a corresponding one of the flutes of the one or more decking panels or through a connection member directly operatively coupled to the top flange, the first bottom flange, the second bottom flange, the first web, or the second web of the corresponding one of the flutes of the one or more decking panels, between the joist of the plurality of joists and an adjacent joist of the plurality of joists.

18. The structure of claim 17, wherein the plurality of joists, the one or more decking panels, and the one or more brace members are pre-formed into a panelized system, and wherein the panelized system is lifted for operative coupling to two or more support members of the plurality of support members of the structure.

19. The structure of claim 17, wherein the plurality of joists lack cross-bracing and horizontal bracing between adjacent joists of the plurality of joists.

20. A method for building a structure, the method comprises:

assembling one or more decking panels to a plurality of joists, wherein each decking panel of the one or more decking panels comprise a plurality of flutes, wherein each flute of the plurality of flutes comprise:

a top flange;

at least a portion of a first bottom flange;

at least a portion of a second bottom flange;

a first web operatively coupling the top flange to the first bottom flange; and a second web operatively coupling the top flange to the second bottom flange; and assembling one or more brace members to the one or more decking panels and the plurality of joists, wherein each brace member of the one or more brace members comprises:

a first end; and a second end;

wherein the first end of the brace member is operatively coupled to a joist of the plurality of joists and the second end of the brace member is directly operatively coupled to the top flange, the first bottom flange, the second bottom flange, the first web, or the second web of a corresponding one of the flutes of the one or more decking panels or through a connection member directly operatively coupled to the top flange, the first bottom flange, the second bottom flange, the first web, or the second web of the corresponding one of the flutes of the one or more decking panels, between the joist of the plurality of joists and an adjacent joist of the plurality of joists.

* * * * *